US006443162B2

(12) United States Patent
Fitjer

(10) Patent No.: US 6,443,162 B2
(45) Date of Patent: Sep. 3, 2002

(54) MASCARA BRUSH

(75) Inventor: Holger H. Fitjer, München (DE)

(73) Assignee: Georg Karl geka-brush GmbH, Bechhofen (DE)

( * ) Notice: Subject to any disclaimer, the term of this patent is extended or adjusted under 35 U.S.C. 154(b) by 0 days.

(21) Appl. No.: 09/735,997

(22) Filed: Dec. 14, 2000

(30) Foreign Application Priority Data

Dec. 14, 1999 (DE) ..... 199 60 173

(51) Int. Cl.[7] ..... A45D 40/26; A46B 11/00

(52) U.S. Cl. ..... 132/218; 132/320; 401/122; 15/206; 15/207.2

(58) Field of Search ..... 132/218, 320, 132/216, 316, 317; 15/206, 207, 207.2; 401/122, 129, 126

(56) References Cited

U.S. PATENT DOCUMENTS 4,733,425 A * 3/1988 Hartel et al. ..... 15/206
4,887,622 A * 12/1989 Gueret ..... 132/320
5,161,554 A * 11/1992 Fitjer ..... 132/218
5,161,555 A * 11/1992 Cansler et al. ..... 132/218
5,761,760 A * 6/1998 Dumler et al. ..... 15/206
6,016,815 A * 1/2000 Christoforou et al. ..... 132/218
6,073,634 A * 6/2000 Gueret ..... 132/218
6,094,769 A * 8/2000 Driesen et al. ..... 15/207.2

FOREIGN PATENT DOCUMENTS

| | | |
|---|---|---|
| DE | 92 02 508.0 | 9/1992 |
| DE | 195 33 815 A1 | 3/1997 |
| DE | 196 40 726 A1 | 4/1998 |
| DE | 196 40 853 A1 | 4/1998 |
| EP | 0 306 052 A2 | 9/1988 |
| FR | 2 627 068 A1 | 2/1988 |

* cited by examiner

*Primary Examiner*—John J. Wilson
*Assistant Examiner*—Robyn Kieu Doan
(74) *Attorney, Agent, or Firm*—Browdy and Neimark, P.L.L.C.

(57) ABSTRACT

In a mascara brush with a plurality of bristles being fixed between two intertwisted wire sections, standing out therefrom on both sides, and with the bristles having a noncircular cross section, it is provided, with a view to improving the mascara transfer properties, that, proceeding from conventionally extruded fibers, at least two of these fibers are connected to each other lengthwise in the form of lines or points.

9 Claims, 2 Drawing Sheets

MASCARA BRUSH

BACKGROUND OF THE INVENTION

1. Field of the Invention

The invention relates to a mascara brush with a plurality of bristles being fixed between two intertwisted wire sections, standing out therefrom on both sides, and with the bristles having a noncircular cross section.

2. Background Art

It is known in mascara brushes to use bristles of cloverleaf cross section or bristles having at least one longitudinal capillary groove and in this way to obtain capillary space for increased mascara absorption and transfer capacity. Furthermore, it has been specified to use circular bristles of varying cross section.

So as to obtain brushes with especially fine bristles in the finished product which would be difficult to treat because of their inferior thickness, it has become known to compose bristles of individual sectors so that an overall circular cross section results during the manufacture of the brush. As soon as the bristles are fixed between the intertwisted wires, the bond of the individual sectors is dissolved by the aid of a solvent so that then bristles of a very small cross section are obtained from these individual sectors, these bristles fanning out conically from one and the same spot where the originally round bristle had been squeezed between the wire sections (cf. U.S. Pat. No. 5,355,547).

SUMMARY OF THE INVENTION

It is an object of the invention to embody a mascara brush or, respectively, to create a bristle for a mascara brush which enable optimum combing and transfer behavior to be realized.

According to the invention, this object is attained in that, proceeding from conventionally extruded fibers, at least two of these fibers are combined lengthwise in the form of lines or points.

This enables nearly any cross-sectional configuration to be produced, in particular in the light of the further possibility of combining fibers of varying diameters. The bristles thus created exhibit in particular a high capillarity.

The fibers may be connected to each other lengthwise in the form of continuous lines. By alternative, point combination of the fibers may be provided, in which case it may be advantageous for at least one fiber not to be parallel to another fiber, but to be approximately wavy, point connection then being produced only in the concavities. In this way, tiny longitudinal eyes will form between two fibers of this type, in which to store mascara.

In keeping with another embodiment, it may be provided that at least part of the fibers are hollow fibers or fibers of noncircular cross section.

The design according to the invention also helps attain a spreading effect and a uniform distribution of the tips.

Connecting the fibers to each other may be implemented by all the types of connection systems that are customary in plastics engineering, in particular thermally, chemically, by ultrasound welding, etc.

Details of the invention will become apparent from the ensuing description of preferred exemplary embodiments, taken in conjunction with the drawing.

DESCRIPTION OF THE PREFERRED EMBODIMENTS

Figure 1:
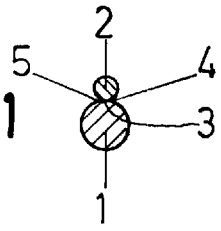
FIG. 1 is a cross sectional view of a first embodiment.
Figure 2:
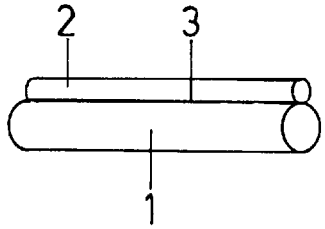
FIG. 2 is a lateral view of details of this embodiment comprising two fibers that are connected to each other.

In the embodiment seen in FIGS. 1 and 2, a first fiber 1 of greater diameter is connected to a second fiber 2 of smaller diameter along a line 3, capillary grooves 4, 5 being formed on both sides of this line 3 to form bristles for use in a mascara brush.

Figure 3:
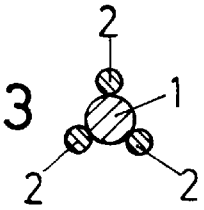
FIG. 3 is a section through a second embodiment comprising four fibers which are connected to each other.
Figure 4:
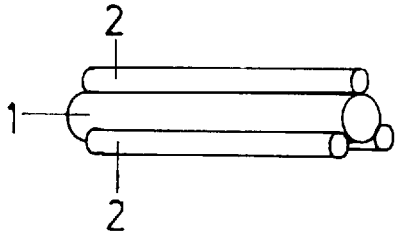
FIG. 4 is a partial lateral view of the embodiment of FIG. 3.

In the embodiment according to FIGS. 3 and 4, a central fiber 1 of greater diameter is combined with three fibers 2 of smaller diameter to form a brush bristle.

Figure 5:
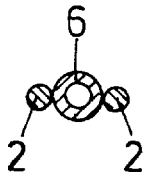
FIG. 5 is a view of the section through an embodiment in which a central hollow fiber is combined with two solid fibers.

The cross-sectional view of FIG. 5 illustrates that a center hollow fiber 6 of greater cross section is connected to two diametrically opposed solid fibers 2 of smaller cross section to form a brush bristle.

Figure 6:
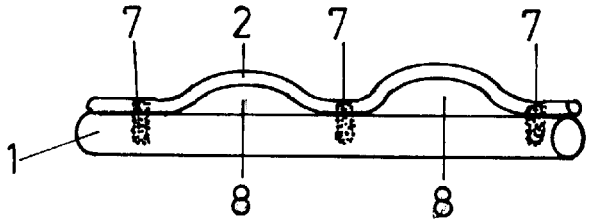
FIG. 6 is an illustration of another embodiment in which eyes are formed in the longitudinal direction between two fibers that are united by point connection.
Figure 7:
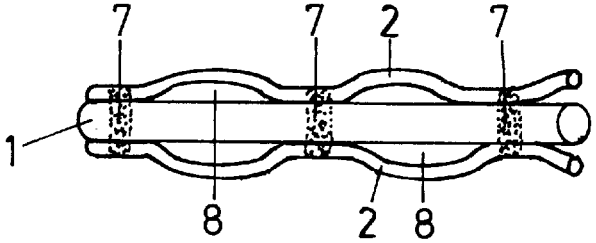
FIG. 7 is an illustration corresponding to FIG. 6 with three fibers being combined.
Figure 8:
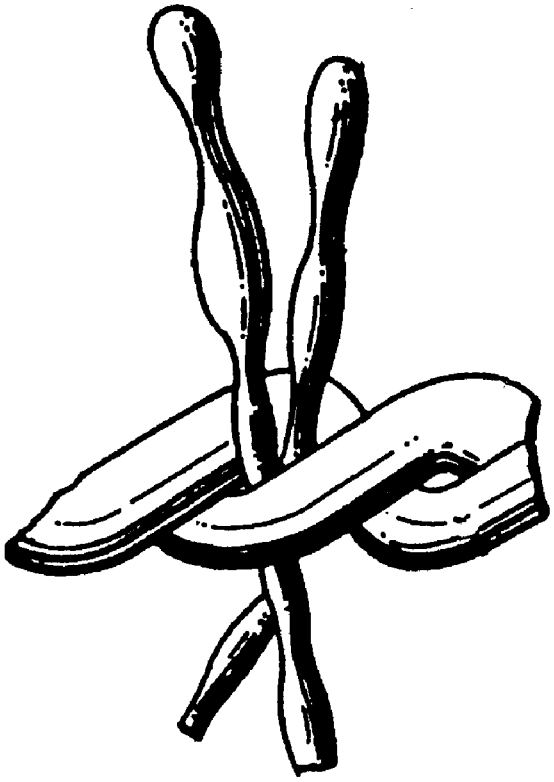
FIG. 8 (PRIOR ART)
FIG. 8 is prior art showing a plurality of bristles fixed between two intertwisted wire sections.

FIGS. 6 and 7 illustrate examples in which a single fiber 2 or two fibers 2 of inferior cross section are connected to a thicker fiber 1 to form a brush bristle only at discrete welding spots 7 with the thinner fiber 2 being wavy for eye type interspaces 8 to form between two successive welding spots 7, creating the possibility of reserve capillarity.

What is claimed is:

1. A mascara brush with a plurality of bristles fixed between two inter-twisted wire sections, wherein each of the plurality of bristles extends out from both sides of the inter-twisted wire sections and has a noncircular cross section;

each of the plurality of bristles being made from at least two conventionally extruded fibers (1, 2) which are fixed together along a substantial length of the fibers.

2. The mascara brush according to claim 1, wherein the fibers (1,2) have different diameters.

3. The mascara brush according to claim 1, wherein at least one of the fibers is hollow.

4. The mascara brush according to claim 1, wherein at least one of the fibers has a noncircular cross section.

5. The mascara brush according to claim 1, wherein the fibers are continuously fixed together in a line over a length of the fibers.

6. The mascara brush according to claim 1, wherein the fibers are fixed together at a plurality of points over a length of the fibers.

7. The mascara brush according to claim 6, wherein at least one of the fibers is wavy and the points of engagement between the fibers are located in the vicinity of concavities (7) of the wavy fiber.

8. A mascara brush with a plurality of bristles fixed between two inter-twisted wire sections, wherein each of the plurality of bristles extends out from both sides of the inter-twisted wire sections and has a noncircular cross section; and wherein each of the plurality of bristles is made from at least two conventionally extruded fibers (1, 2) which are fixed together in a line over a substantial length of the fibers.

9. A mascara brush with a plurality of bristles fixed between two inter-twisted wire sections, wherein each of the plurality of bristles extends out from both sides of the inter-twisted wire sections and has a noncircular cross section; and wherein each of the plurality of bristles is made from at least two conventionally extruded fibers (1, 2) which are fixed together at a plurality of points over a substantial length of the fibers.

* * * * *